United States Patent [19]

Romanowicz et al.

[11] 4,382,722

[45] May 10, 1983

[54] NINE LINING STRUCTURE

[75] Inventors: Stanislaw Romanowicz, Gliwice; Wojciech Skoczyński, Katowice; Edward Janik, Bytom, all of Poland

[73] Assignee: Centrum Konstrukcyino-Technologiczne Maszyn Gorniczych "KOMAG", Pszczynska, Poland

[21] Appl. No.: 230,419

[22] Filed: Feb. 2, 1981

[51] Int. Cl.[3] ..... E21D 15/44

[52] U.S. Cl. ..... 405/291; 405/295

[58] Field of Search ..... 405/292–301; 248/421

[56] References Cited

U.S. PATENT DOCUMENTS

| | | | |
|---|---|---|---|
| 1,691,634 | 11/1928 | Bienvenu | 248/421 X |
| 2,657,028 | 10/1953 | Joy | 405/298 |
| 3,978,679 | 9/1976 | LeComte | 405/159 |
| 4,020,640 | 5/1977 | Sigott et al. | 405/296 X |
| 4,048,804 | 9/1977 | Elsner et al. | 405/295 |
| 4,065,930 | 1/1978 | Spies | 405/296 |

FOREIGN PATENT DOCUMENTS

| | | | |
|---|---|---|---|
| 1458701 | 10/1969 | Fed. Rep. of Germany | 405/300 |
| 2848506 | 5/1979 | Fed. Rep. of Germany | 405/296 |
| 862921 | 3/1961 | United Kingdom | 405/297 |

*Primary Examiner*—Dennis L. Taylor

*Attorney, Agent, or Firm*—Ladas & Parry

[57] ABSTRACT

The roof support according to the invention is between the roof-bar (2) and the sill piece (1) with at least one system of levers (3,4) connected by articulation with each other and connected by articulation with the roof-bar (2) and the sill piece (1) so that they have the form of a lying letter V directed with its vertex towards the fall. Between the levers (3,4) it is provided with the hydraulic cylinder (5) spragging the levers (3,4) and thus the lining. That admits to achieve a high multiplication of the cylinder travel in relation to the change of the lining height, and a multiplication of forces. In shield roof supports of a lemniscate type the lever system can consist of the fall shield (6) and the outside arm (7) of the lemniscate arrangement.

3 Claims, 5 Drawing Figures

NINE LINING STRUCTURE

This invention relates to a mine lining structure, especially a shield roof support, having a wide range of height and supporting capacity, provided with an indirect spragging system.

From the Polish Pat. No. 63 639 there is known a roof support with indirect spragging system consisting of a system of levers connected by articulation, having the form of a lying letter V. The system for spragging the lever system, and thus spragging indirectly the lining, consists of a horizontal hydraulic cylinder fitted with one its end to the articulated joint connecting the levers of the spragging system, and with its other end to a stable base, for instance to a suitably formed sill piece. The spragging system can constitute a pair of levers arranged in a push-pull system, and the spragging cylinder connects the opposed arms of the spragging system with each other. The lining did not found a practical application for constructional and operational reasons in spite of its indubitable advantages, as a large height range and an increase of the supporting force concurrently with the increase of the height and with simultaneous decrease of the spragging force of the cylinder. Practically, however, for to cover the possible height range a large travel of the cylinder stretching the levers is necessary, what, among others, complicates the crew traffic within the lining.

The object of the invention is the achieving of high multiplication of the cylinder travel in relation to the lining height change, and of high multiplication of the spragging force of the cylinder in relation to the supporting capacity of the lining, increasing concurrently with the height increase, at simultaneous increase of the crew traffic space.

Said object is achieved through connecting by articulation of the spragging cylinder with the arms of the known lever system connecting the sill piece with the roof-bar, whereby it is advantageous to situate the lever system in that manner that the connecting articulated joint is directed towards the fall, and the spragging cylinder is inclined towards the body.

In known shield roof supports, especially those of lemniscate type, the system of levers constituting the lemniscate arrangement can fulfil functions of the spragging system, and in this case the spragging cylinder connects the shield with the outside lever of the lemniscate arrangement.

The design according to the invention admits to cover a considerable area of variations of the lining height with a relatively small travel of the spragging cylinder and simultaneous maintenance of the principle of increase of the lining supporting capacity with increase of the height of spragging. Moreover, the employed system does not limit the crew traffic area along the lining beyond the limits observable in actually employed linings.

Figure 1:
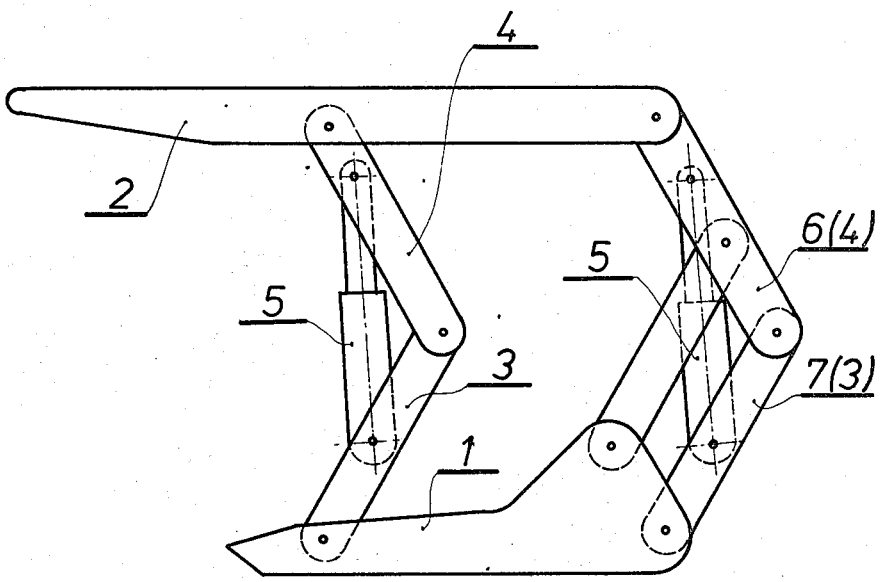

The roof support according to the invention is presented by way of exemplary embodiments with reference to the accompanying drawing, wherein:

FIG. 1 is a side view of a shield roof support with multiple spragging system, and FIGS. 2, 3, 4, and 5 are side views of a shield roof support in exemplary embodiments.

As shown in FIG. 1 the lining according to the invention is provided between the sill piece 1 and the roof-bar 2 with at least one pair of levers 3, 4 connected by articulation with one end to the roof-bar 2 and the sill piece 1, and connected by articulation one with the other this way that they have a form of a lying letter V directed with the vertex towards the fall. Between the levers 3, 4 the hydraulic cylinder 5 is fitted the ends whereof are connected by articulation with the levers 3, 4 so that the spragging of the cylinder 5 is accompanied by an opening of the levers 3, 4 and thus by a change of the lining height. Especially advantageous force system occurs in the case of inclination of the cylinder 5 towards the body front.

For shield roof supports of lemniscate type the system of spragging levers consists of the fall shield 6 and the outside arm 7 of the lemniscate arrangement, between which the spragging cylinder is fitted 5.

Figure 2:
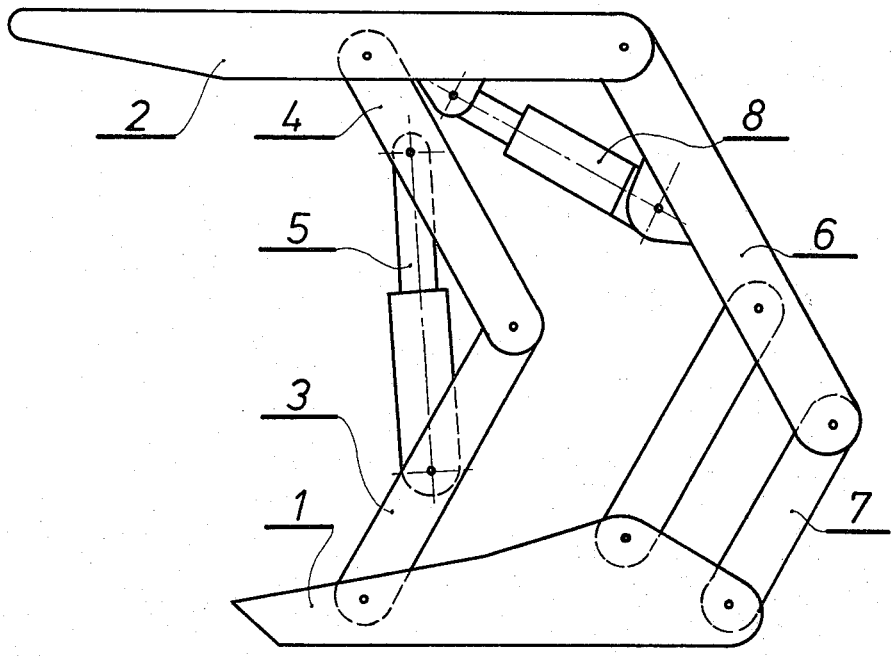
Figure 3:
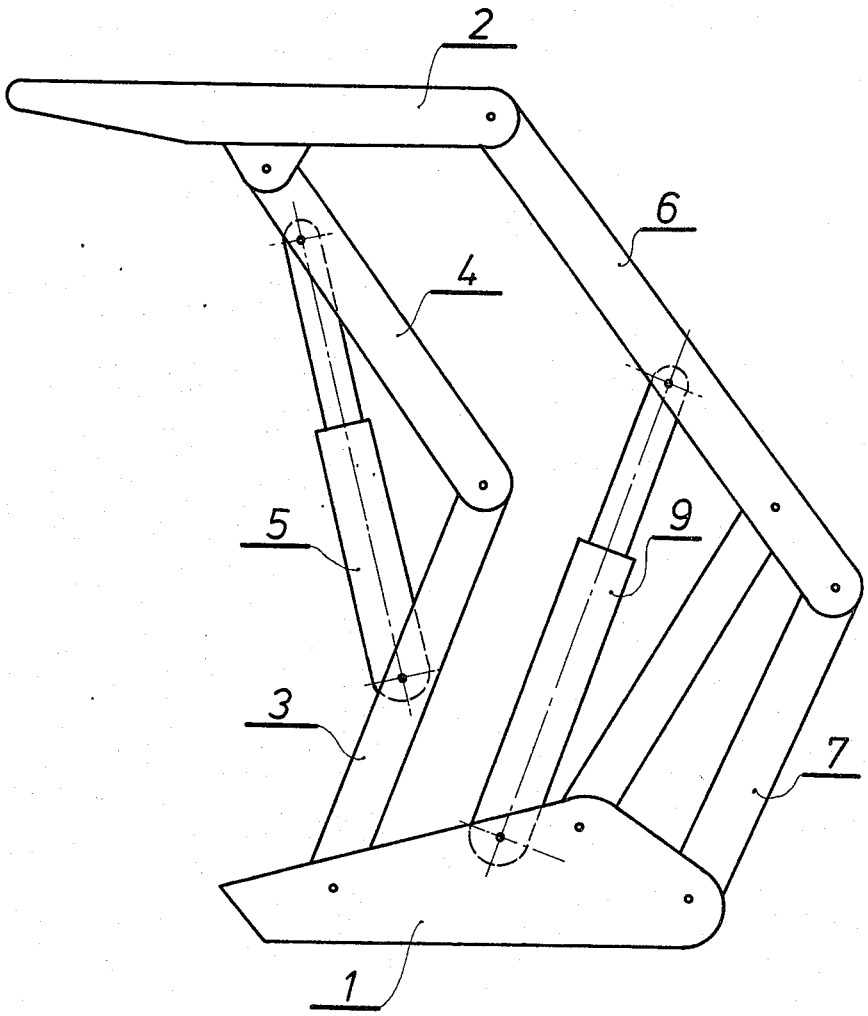

The exemplary embodiments shown in FIGS. 2 and 3 correspond essentially with that according to FIG. 1. The spragging cylinder 8 is arranged between the fall shield 6 and the roof-bar 2. In FIG. 3, then, the spragging cylinder 9 is fitted between the fall shield 6 and the sill piece 1.

Figure 4:
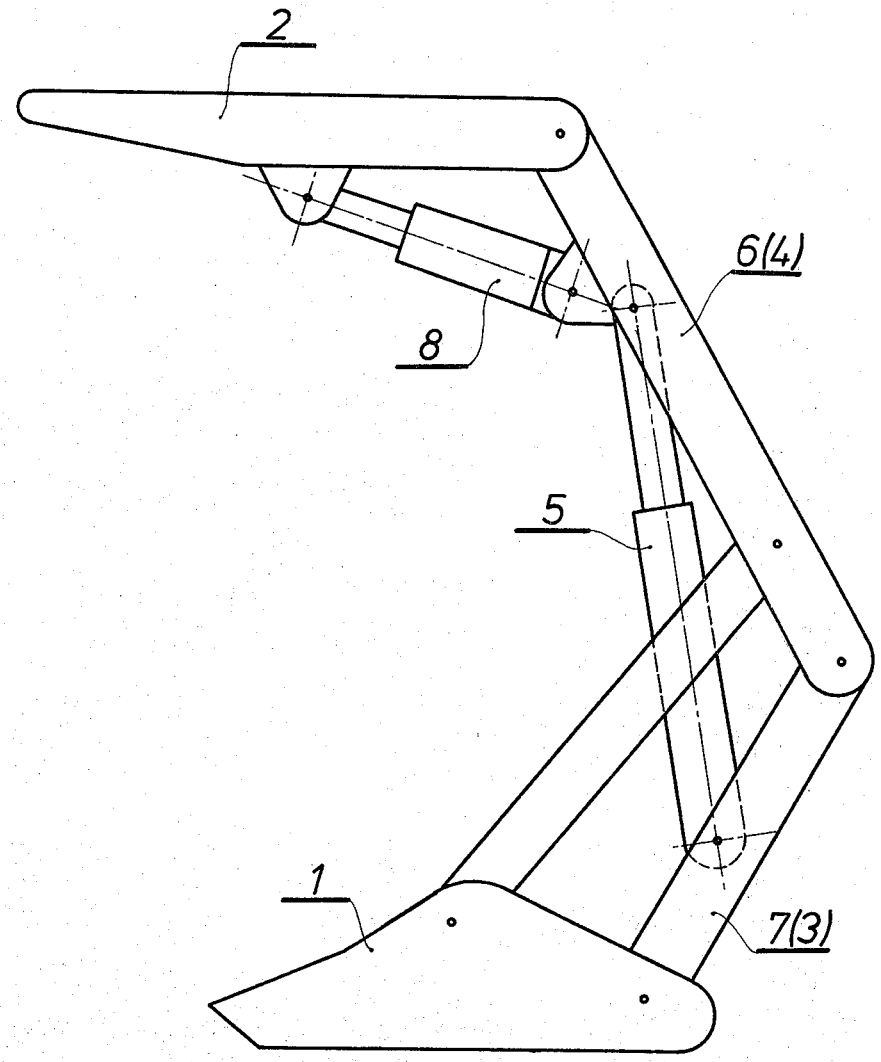

The exemplary embodiment shown in FIG. 4 is provided with one pair of spragging levers. The spragging lever system consists of the fall shield 6 and the outside arm 7. Between the fall shield 6 and the roof-bar 2 there is connected by articulation the spragging cylinder 8.

Figure 5:
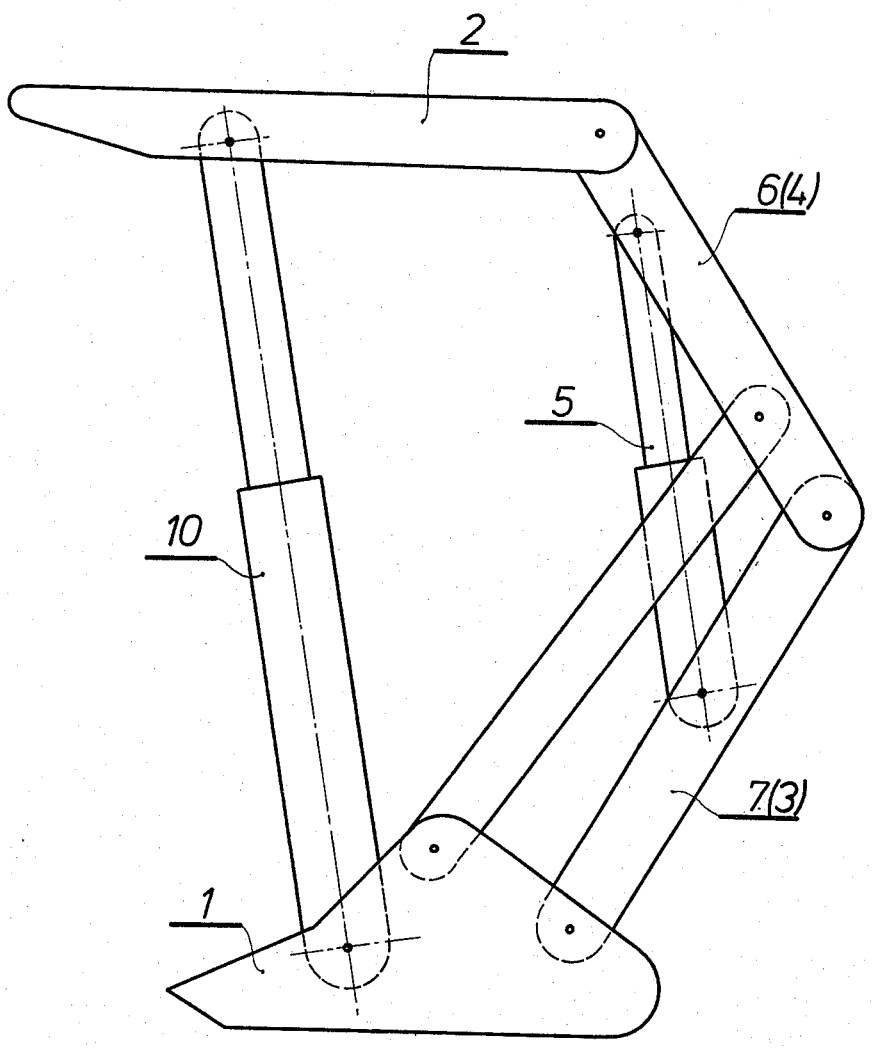

The roof support shown in the exemplary embodiment after FIG. 5 corresponds with the exemplary embodiment after FIG. 4 and is provided with the hydraulic cylinder 10 fitted by articulation between the roof-bar 2 and the sill piece 1. The spragging cylinder 5, instead, is connected by articulation with the fall shield 6 and the arm 7.

What is claimed is:

1. A mine lining structure comprising a sill piece, a roof bar and a plurality of spragging levers interconnecting said sill piece and said roof bar characterized in having one lever pivotally connected at one of its ends to said sill piece, in having a second lever pivotally connected at one of its ends to said roof bar, said one and said second levers being pivotally connected together at ends opposite said sill piece and roof bar to form a pair of connected levers in the form of a horizontally extending V with the apex of the V adopted to extend towards a mine fall; and in having a hydraulic actuator comprising a hydraulic cylinder and piston rod slidable therein operatively positioned between said pair of levers with an end of said cylinder pivotally connected to one of said levers forming said pair and one end of said piston rod pivotally connected at one end to the other of said levers forming said pair whereby movement of said piston rod relative to said hydraulic cylinder will cause movement of the roof bar and sill piece relative to each other.

2. A mine lining structure according to claim 1 further characterized in that one of said levers forming said pair of levers is a fall shield.

3. A mine lining structure according to claim 2 further characterized in that the hydraulic cylinder and piston rod are inclined towards said fall shield.

* * * * *

UNITED STATES PATENT AND TRADEMARK OFFICE

CERTIFICATE OF CORRECTION

PATENT NO. : 4382722

DATED : May 10, 1983

INVENTOR(S) : Romanowicz et al

It is certified that error appears in the above—identified patent and that said Letters Patent is hereby corrected as shown below:

Title of the Invention: Mine Lining Structure
not Nine Lining Structure

Signed and Sealed this

*Fifth* Day of *July 1983*

[SEAL]

*Attest:*

GERALD J. MOSSINGHOFF

*Attesting Officer*

*Commissioner of Patents and Trademarks*